US010220484B2

(12) United States Patent
Xue et al.

(10) Patent No.: US 10,220,484 B2
(45) Date of Patent: Mar. 5, 2019

(54) SIZE-VARIABLE WHEEL DEBURRING DEVICE

(71) Applicant: CITIC Dicastal CO., LTD., Qinhuangdao, Hebei (CN)

(72) Inventors: Bowen Xue, Qinhuangdao (CN); Jiandong Guo, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 169 days.

(21) Appl. No.: 15/604,174

(22) Filed: May 24, 2017

(65) Prior Publication Data

US 2017/0348817 A1 Dec. 7, 2017

(51) Int. Cl.

| | |
|---|---|
| ***B24B 5/44*** | (2006.01) |
| ***B24B 9/04*** | (2006.01) |
| ***B24B 29/00*** | (2006.01) |
| ***B24B 41/00*** | (2006.01) |
| ***B24B 41/06*** | (2012.01) |

(52) U.S. Cl.

CPC ..... *B24B 9/04* (2013.01); *B24B 5/44* (2013.01); *B24B 29/005* (2013.01); *B24B 41/00* (2013.01); *B24B 41/06* (2013.01)

(58) Field of Classification Search

CPC .. B24B 9/00; B24B 9/002; B24B 9/04; B24B 27/00; B24B 29/00; B24B 29/005; B24B 5/44; B24B 31/00; B24B 41/00; B24B 41/06; B24J 9/08; B24D 13/02; B25J 9/08; B25J 9/10

USPC ..... 451/51, 59, 61, 246, 249, 254, 258

See application file for complete search history.

(56) References Cited

FOREIGN PATENT DOCUMENTS

| | | | |
|---|---|---|---|
| CN | 103481215 A | | 1/2014 |
| CN | 103692308 A | * | 4/2014 |
| CN | 203600007 U | * | 5/2014 |
| CN | 203792124 U | | 8/2014 |
| CN | 205630193 U | | 10/2016 |
| JP | H08252753 A | | 10/1996 |
| JP | 2006218601 A | | 8/2006 |

OTHER PUBLICATIONS

CN-203600007-U translation, Espacenet website (Year: 2018).*
CN-103692308-A translation, Espacenet website (Year: 2018).*

* cited by examiner

*Primary Examiner* — Joseph J Hail
*Assistant Examiner* — Timothy Brian Brady
(74) *Attorney, Agent, or Firm* — Syncoda LLC; Feng Ma

(57) ABSTRACT

Disclosed is a size-variable wheel deburring device including combined manipulators, a transfer manipulator, a burr brushing system, fixture systems, and so on. Pneumatic fingers grip shanks of retaining pins to bring pin bodies into fit with first retaining sleeves and second retaining sleeves, and retaining lugs with guide grooves. Springs are compressed to cause 90-degree rotation of pin bodies such that retaining lugs come into retaining grooves of the second retaining sleeves. A brush is driven by a driving motor to rotate and elevated by right elevating cylinders to contact with a back cavity of a wheel for deburring. The size-variable wheel deburring device is capable of automatically adjusting the size of the brush and of each fixture according to the diameters of wheels in use, and realizing mixed online burr brushing, and additionally has the characteristics of advanced technique, high automation degree, good universality, and safe and stable performance.

4 Claims, 8 Drawing Sheets

SIZE-VARIABLE WHEEL DEBURRING DEVICE

CROSS-REFERENCE TO RELATED APPLICATIONS

This application is filed based upon and claims priority to Chinese Patent Application No. 201610381209.6, filed on Jun. 1, 2016, the entire contents of which are incorporated herein by reference.

TECHNICAL FIELD

The disclosure relates to a deburring device, and specifically to a deburring device capable of automatically changing the size of a brush according to the diameters of wheels.

BACKGROUND

At present, almost all the wheel production enterprises employ mixed line production. That is, wheels transferred between steps in the production lines are different in size. This situation has great influence on a burr brushing step. In a traditional burr brushing mode, wheels must be first classified manually by size, and then delivered to dedicated equipment for burr brushing. Due to different sizes of wheels, it requires frequent changing of fixtures and brushes of the burr brushing equipment, causing serious influence on the production efficiency. Hence, in order to enhance the universality of the burr brushing equipment, more and more wheel production enterprises are developing burr brushing equipment applicable to wheels different in size.

SUMMARY

An objective of the disclosure is to provide a size-variable wheel deburring device that is capable of automatically adjusting the size of a brush and the sizes of fixtures according to the diameters of wheels, and also capable of realizing mixed online burr brushing.

In order to achieve the above objective, the technical solution of the disclosure is as follows: a size-variable wheel deburring device consists of a main frame, auxiliary frames, left elevating frames, first guide pillars, a driving motor, second guide pillars, second guide sleeves, first guide sleeves, a first belt wheel, a first lower lifting plate, a synchronous belt, a second lower lifting plate, first guide rails, movable plates, translational cylinders, first servomotors, vertical plates, first bearing seats, first rotating shafts, second servomotors, U-shaped brackets, pneumatic fingers, retaining pins, first retaining sleeves, servo electric cylinders, retaining plates, second guide rails, clamping jaws, second retaining sleeves, a left holding arm, a first gear, a first rack, a left sliding plate, a third guide rail, an upper lifting plate, third guide pillars, a movable bracket, third guide sleeves, upper lifting cylinders, a right sliding plate, a right holding arm, a brush, a second rotating shaft, a second bearing seat, a second belt wheel, right elevating cylinders, a stopper, a roller way, a clamping cylinder, a cross beam, a fourth guide rail, a second rack, a third servomotor, and a second gear. A combination manipulator is configured as follows: four second guide sleeves are fixed to a platform of the auxiliary frame, and four second guide pillars matching with the four second guide sleeves are fixed to a lower end of the second lower lifting plate; the left elevating frame is fixed below the platform of the auxiliary frame and has an output end hinged to the bottom of the second lower lifting plate; a slider of the first guide rail is fixed above the second lower lifting plate; a sliding rail of the first guide rail is fixed below the movable plate; the translational cylinder is fixed above the movable plate and has an output end connected to a side surface of the second lower lifting plate; the first servomotor is fixed at a left side of the vertical plate; the first bearing seat is fixed at a right side of the vertical plate; the first rotating shaft is mounted in the first bearing seat by means of a bearing; the U-shaped bracket is mounted at a right side of the first rotating shaft, and a left side of the first rotating shaft is connected to an output end of the first servomotor; the second servo motor is fixed below the U-shaped bracket and has an output end connected to the pneumatic finger mounted inside the U-shaped bracket. The device includes left and right sets of such combined manipulators.

A transfer manipulator is configured as follows: the left holding arm is fixed below the left sliding plate; the left sliding plate is mounted below the upper lifting plate by means of the third guide rail; the holding arm is fixed below the right sliding plate; the first gear is mounted below the upper lifting plate; the first rack that is separately fixed to the left sliding plate and the right sliding plate is engaged with the first gear; the clamping cylinder is fixed to the left sliding plate and has an output end engaged with the right sliding plate; four third guide pillars fixed above the upper lifting plate are matched with four third guide sleeves on a bottom plate of the movable bracket; two upper lifting cylinders are fixed to the bottom plate of the movable bracket and have output ends hinged to a top end of the upper lifting plate; a side surface of the movable bracket is mounted on the cross beam by means of the fourth guide rail; the third servomotor with the second gear mounted at an output end thereof is fixed above a top plate of the movable bracket, and the second gear is engaged with the second rack that is mounted at a top end of the cross beam.

A burr brushing system is configured as follows: four first guide pillars are fixed between a bottom plate and a working platform of the main frame, and four first guide sleeves matching with the four first guide pillars are fixed to the first lower lifting plate; the driving motor with the first belt wheel mounted at an output end thereof is fixed below the first lower lifting plate; the second bearing seat is fixed above the first lower lifting plate, and the second rotating shaft is mounted within the second bearing seat by means of a bearing; the brush is fixed to an upper end of the second rotating shaft, while the second belt wheel is mounted at a lower end of the second rotating shaft; the first belt wheel is connected to the second belt wheel by means of the synchronous belt; two right elevating cylinders are fixed to the bottom of the main frame and have output ends hinged to the bottom of the first lower lifting plate.

A fixture system is configured as follows: a slider of the second guide rail is fixed to the working platform of the main frame; the retaining plate is mounted above a sliding rail; the servo electric cylinder is fixed above the retaining plate and has an output end connected to the vertical plate on the working platform of the main frame; the clamping jaw is fixed to a tail end of the second guide rail. The device includes four such fixture systems.

The stopper is mounted at a tail end of the roller way.

The first retaining sleeves and the second retaining sleeves are fixed below lantern rings and a base body, respectively.

The retaining pins are matched with both the first retaining sleeves and the second retaining sleeves.

Each retaining pin includes a pin body, a spring, a catch, a retaining lug, and a shank, with the shank fixed at a left side of the pin body, the spring being sleeved the pin body, the catch being capable of sliding on the pin body and disposed at a right side of the spring, and the retaining lug fixed to a right tail end of the pin body.

Each of the first retaining sleeves and the second retaining sleeves is provided with a guide groove. Each second retaining sleeve is provided at both sides thereof in a 90-degree direction of the guide groove with two retaining grooves for matching with the retaining lug on the corresponding retaining pin.

The brush is composed of the base body and the lantern rings. A groove is circumferentially formed in the periphery of the base body. The lantern rings are two semicircles with respective semicircular lug bosses at outer sides thereof for matching with the groove in the base body.

In practical use, the stopper retains a wheel on the roller way. The clamping cylinder enables, via the first rack and the first gear, the left holding arm and the right holding arm to clamp the wheel. The lifting cylinders lift the wheel by means of the third guide pillars. The third servomotors allow transfer of the wheel to be above the fixtures by means of the second rack and the second gear. The servo electric cylinders automatically adjust the positions of the clamping jaws according to the diameter of the wheel. If the diameter of the wheel is increased, the transitional cylinders allow the installation of the lantern rings gripped by the pneumatic fingers on the base body by means of the first guide rails. The first servomotors enable, by means of the first rotating shafts, the pneumatic fingers to rotate by 90 degrees, while the second servomotors also enable the pneumatic fingers to rotate by 90 degrees. The pneumatic fingers grip the shanks of the retaining pins to bring the pin bodies into fit with the first retaining sleeves and the second retaining sleeves, and the retaining lugs with the guide grooves. The springs are compressed to cause 90-degree rotation of the pin bodies such that the retaining lugs come into the retaining grooves of the second retaining sleeves. The brush is driven by the driving motor to rotate and elevated by the right elevating cylinders to contact with the back cavity of the wheel for deburring.

The size-variable wheel deburring device permits automatic regulation of the sizes of the brush and the fixtures according to the diameters of the wheels in use, and achievement of mixed online burr brushing, and additionally has the characteristics of advanced technique, high automation degree, good universality, and safe and stable performance.

LIST OF REFERENCE SYMBOLS

Figure 1:
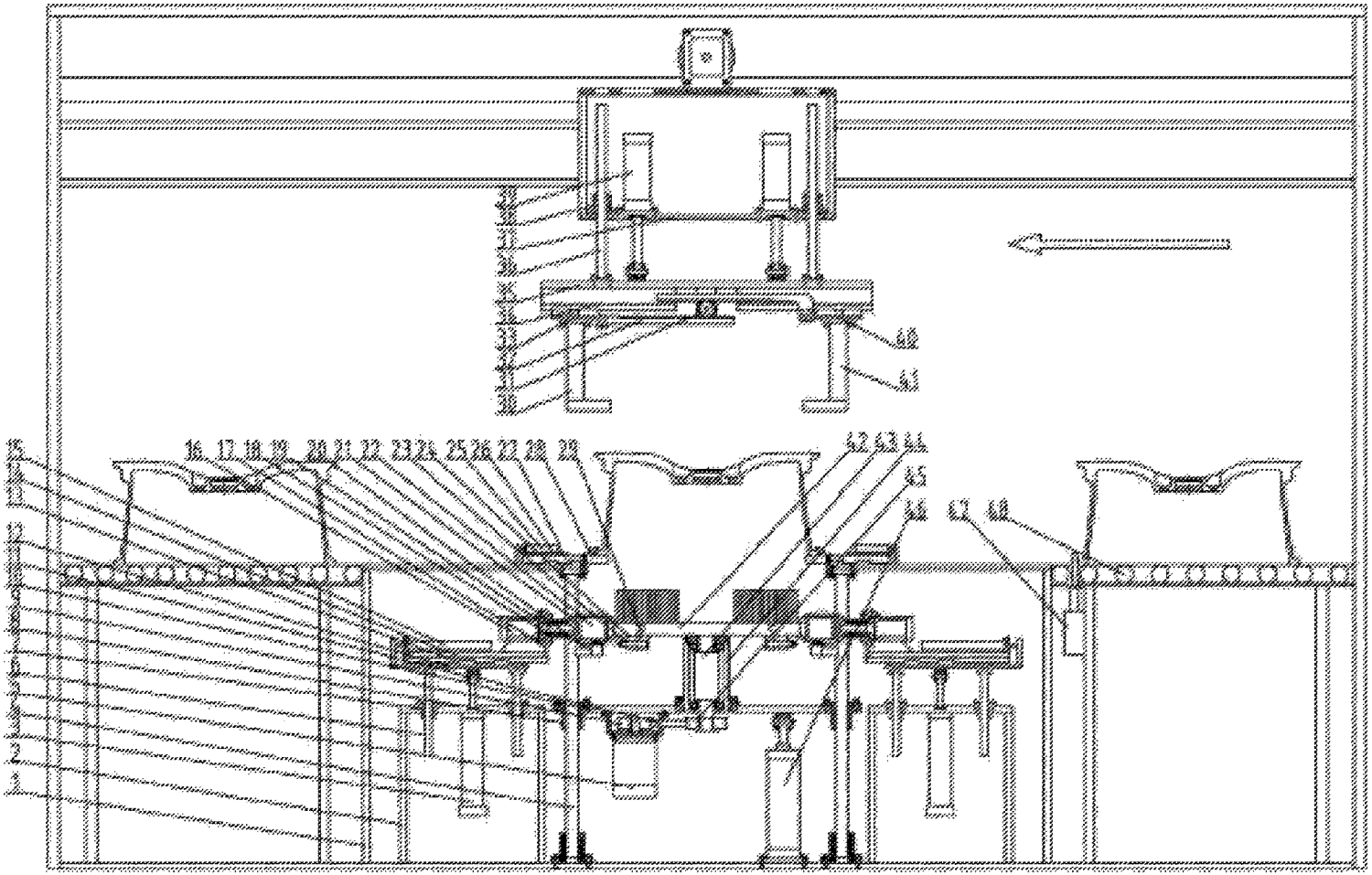
FIG. 1 is a front view of a size-variable wheel deburring device of the disclosure.
Figure 2:
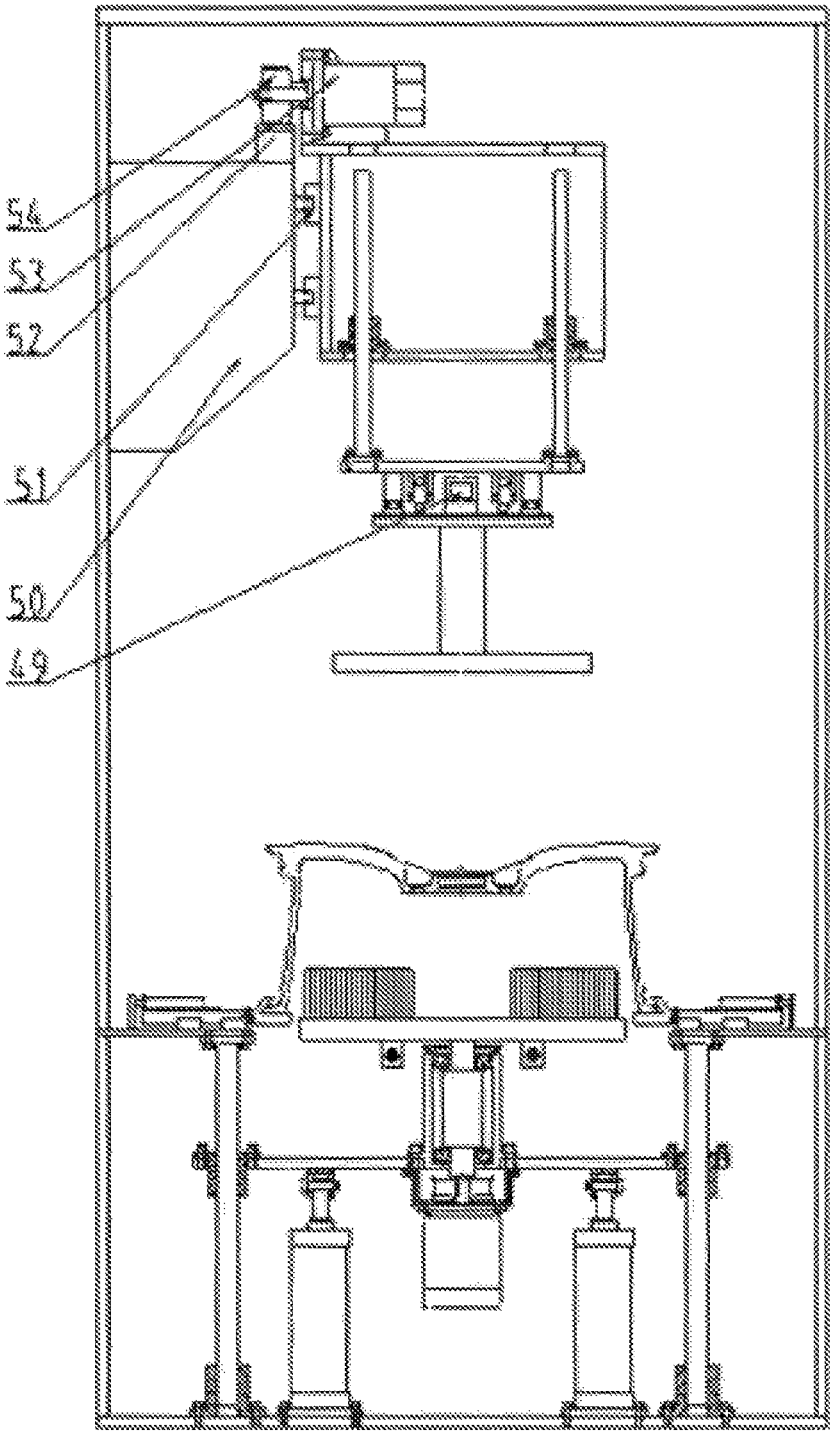
FIG. 2 is a left view of the size-variable wheel deburring device of the disclosure.
Figure 3:
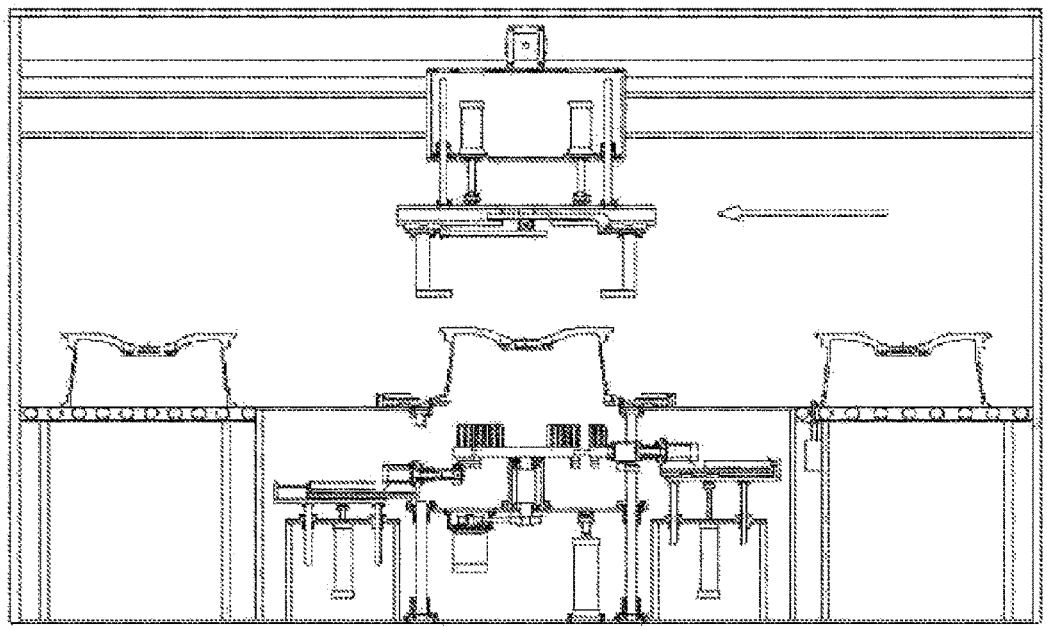
FIG. 3 is a principal view of the size-variable wheel deburring device of the disclosure when a brush is assembled.
Figure 4:
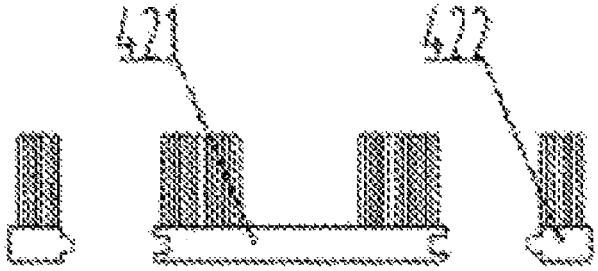
FIG. 4 is a principal view of the brush of the size-variable wheel deburring device of the disclosure.
Figure 5:
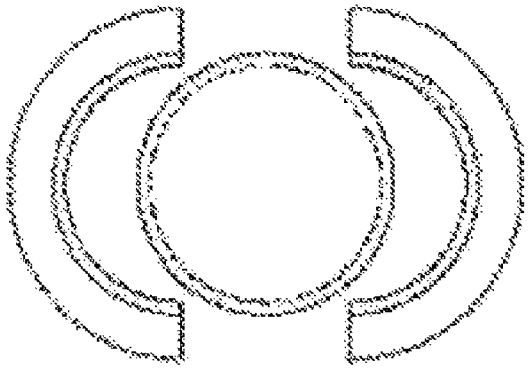
FIG. 5 is a top view of the brush of the size-variable wheel deburring device of the disclosure.
Figure 6:
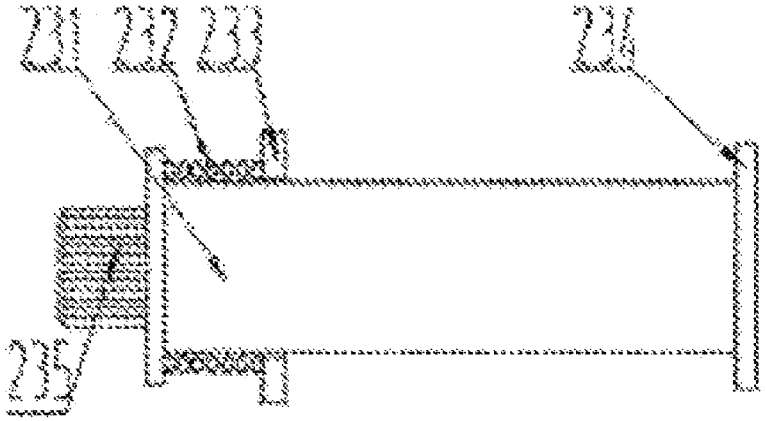
FIG. 6 is a principal view of a retaining pin of the size-variable wheel deburring device of the disclosure.
Figure 7:
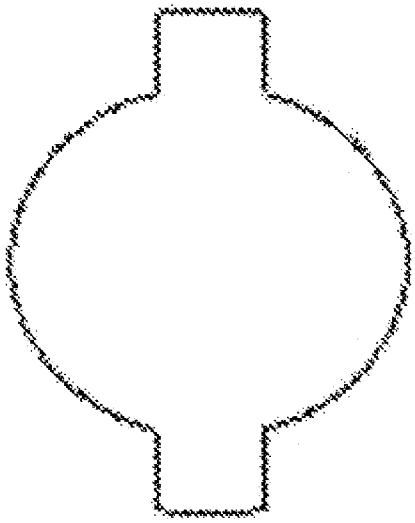
FIG. 7 is a left view of the retaining pin of the size-variable wheel deburring device of the disclosure.
Figure 8:
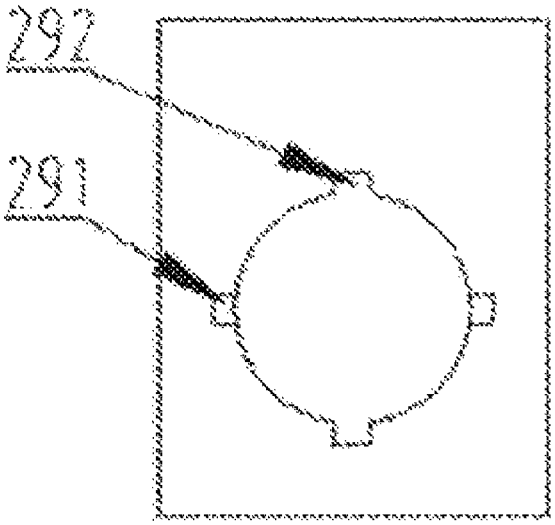
FIG. 8 is a left view of a second retaining sleeve of the size-variable wheel deburring device of the disclosure.

1 Main frame
2 Auxiliary frame
3 Left elevating frame
4 First guide pillar
5 Driving motor
6 Second guide pillar
7 Second guide sleeve
8 First guide sleeve
9 First belt wheel
10 First lower lifting plate
11 Synchronous belt
12 Second lower lifting plate
13 First guide rails
14 Movable plate
15 Translational cylinder
16 First servomotor
17 Vertical plate
18 First bearing seat
19 First rotating shaft
20 Second servomotor
21 U-shaped bracket
22 Pneumatic finger
23 Retaining pin
24 First retaining sleeve
25 Servo electric cylinder
26 Retaining plate
27 Second guide rail
28 Gripping jaw
29 Second retaining sleeve
30 Left holding arm
31 First gear
32 First rack
33 Left sliding plate
34 Third guide rail
35 Upper lifting plate
36 Third guide pillar
37 Movable bracket
38 Third guide sleeve
39 Upper lifting cylinder
40 Right sliding plate
41 Right holding arm
42 Brush
43 Second rotating shaft
44 Second bearing seat
45 Second belt wheel
46 Right elevating cylinder
47 Stopper
48 Roller way
49 Clamping cylinder
50 Cross beam
51 Fourth guide rail
52 Second rack
53 Third servomotor
54 Second gear
231 Pin body
232 Spring
233 Catch
234 Retaining lug
235 Shrank
421 Base body
422 Lantern ring
291 Retaining groove
292 Guide groove

DETAILED DESCRIPTION

Details and working conditions of the specific device provided according to the disclosure will be described below in conjunction with the accompanying drawings.

The device consists of a main frame 1, auxiliary frames 2, left elevating frames 3, first guide pillars 4, a driving motor 5, second guide pillars 6, second guide sleeves 7, first guide sleeves 8, a first belt wheel 9, a first lower lifting plate 10, a synchronous belt 11, a second lower lifting plate 12, first guide rails 13, movable plates 14, translational cylinders 15, first servomotors 16, vertical plates 17, first bearing seats 18, first rotating shafts 19, second servomotors 20, U-shaped brackets 21, pneumatic fingers 22, retaining pins 23, first retaining sleeves 24, servo electric cylinders 25, retaining plates 26, second guide rails 27, clamping jaws 28, second retaining sleeves 29, a left holding arm 30, a first gear 31, a first rack 32, a left sliding plate 33, a third guide rail 34, an upper lifting plate 35, third guide pillars 36, a movable bracket 37, third guide sleeves 38, upper lifting cylinders 39, a right sliding plate 40, a right holding arm 41, a brush 42, a second rotating shaft 43, a second bearing seat 44, a second belt wheel 45, right elevating cylinders 46, a stopper 47, a roller way 48, a clamping cylinder 49, a cross beam 50, a fourth guide rail 51, a second rack 52, a third servomotor 53, and a second gear 54. A combination manipulator is configured as follows: four second guide sleeves 7 are fixed to a platform of the auxiliary frame 2, and four second guide pillars 6 matching with the four second guide sleeves are fixed to a lower end of the second lower lifting plate 12; the left elevating frame 3 is fixed below the platform of the auxiliary frame 2 and has an output end hinged to the bottom of the second lower lifting plate 12; a slider of the first guide rail 13 is fixed above the second lower lifting plate 12; a sliding rail of the first guide rail 13 is fixed below the movable plate 14; the translational cylinder 15 is fixed above the movable plate 14 and has an output end connected to a side surface of the second lower lifting plate 12; the first servomotor 16 is fixed at a left side of the vertical plate 17; the first bearing seat 18 is fixed at a right side of the vertical plate 17; the first rotating shaft 19 is mounted in the first bearing seat 18 by means of a bearing; the U-shaped bracket 21 is mounted at a right side of the first rotating shaft 19, and a left side of the first rotating shaft 19 is connected to an output end of the first servomotor 16; the second servo motor 20 is fixed below the U-shaped bracket 21 and has an output end connected to the pneumatic finger 22 mounted inside the U-shaped bracket 21. The device includes left and right sets of such combined manipulators.

A transfer manipulator is configured as follows: the left holding arm 30 is fixed below the left sliding plate 33, the left sliding plate 33 is mounted below the upper lifting plate 35 by means of the third guide rail 34; the holding arm 41 is fixed below the right sliding plate 40; the first gear 31 is mounted below the upper lifting plate 35; the first rack 32 that is separately fixed to the left sliding plate 33 and the right sliding plate 40 is engaged with the first gear 31; the clamping cylinder 49 is fixed to the left sliding plate 33 and has an output end engaged with the right sliding plate 40; four third guide pillars 36 fixed above the upper lifting plate 35 are matched with four third guide sleeves 38 on a bottom plate of the movable bracket 37; two upper lifting cylinders 39 are fixed to the bottom plate of the movable bracket 37 and have output ends hinged to a top end of the upper lifting plate 35; a side surface of the movable bracket 37 is mounted on the cross beam 50 by means of the fourth guide rail 51; the third servomotor 53 with a second gear 54 mounted at an output end thereof is fixed above a top plate of the movable bracket 37, and the second gear 54 is engaged with the second rack 52 that is mounted at a top end of the cross beam 50.

A burr brushing system is configured as follows: four first guide pillars 4 are fixed between a bottom plate and a working platform of the main frame 1, and four first guide sleeves 8 matching with the four first guide pillars are fixed to the first lower lifting plate 10; the driving motor 5 with the first belt wheel 9 mounted at an output end thereof is fixed below the first lower lifting plate 10; the second bearing seat 44 is fixed above the first lower lifting plate 10, and the second rotating shaft 43 is mounted within the second bearing seat 44 by means of a bearing; the brush 42 is fixed to an upper end of the second rotating shaft 43, while the second belt wheel 45 is mounted at a lower end of the second rotating shaft 43; the first belt wheel 9 is connected to the second belt wheel 45 by means of the synchronous belt 11; two right elevating cylinders 46 are fixed to the bottom of the main frame 1 and have output ends hinged to the bottom of the first lower lifting plate 10.

A fixture system is configured as follows: a slider of the second guide rail 27 is fixed to the working platform of the main frame 1; the retaining plate 26 is mounted above a sliding rail; the servo electric cylinder 25 is fixed above the retaining plate 26 and has an output end connected to the vertical plate on the working platform of the main frame 1; the clamping jaw 28 is fixed to a tail end of the second guide rail 27. The device includes four such fixture systems.

The stopper 47 is mounted at a tail end of the roller way 48.

The first retaining sleeves 24 and the second retaining sleeves 29 are fixed below lantern rings 422 and a base body 421, respectively.

The retaining pins 23 are matched with both the first retaining sleeves 24 and the second retaining sleeves 29.

Each retaining pin 23 includes a pin body 231, a spring 232, a catch 233, a retaining lug 234, and a shank 235, with the shank 235 fixed at a left side of the pin body 231, the spring 232 being sleeved the pin body 231, the catch 233 being capable of sliding on the pin body 231 and disposed at a right side of the spring 232, and the retaining lug 234 fixed to a right tail end of the pin body 231.

Each of the first retaining sleeves 24 and the second retaining sleeves 29 is provided with a guide groove 292. Each second retaining sleeve 29 is provided at both sides thereof in a 90-degree direction of the guide groove 292 with two retaining grooves 291 for matching with the retaining lug 234 on the corresponding retaining pin 23.

The brush 42 is composed of the base body 421 and the lantern rings 422. A groove is circumferentially formed in the periphery of the base body 421. The lantern rings 422 are two semicircles with respective semicircular lug bosses at outer sides thereof for matching with the groove in the base body 421.

During working, the stopper 47 retains a wheel on the roller way 48. The clamping cylinder 49 enables, via the first rack 32 and the first gear 31, the left holding arm 30 and the right holding arm 41 to clamp the wheel. The lifting cylinders 39 lift the wheel by means of the third guide pillars 36. The third servomotors 53 allow transfer of the wheel to be above the fixtures by means of the second rack 52 and the second gear 54. The servo electric cylinders 25 automatically adjust the positions of the clamping jaws 28 according to the diameter of the wheel. If the diameter of the wheel is increased, the transitional cylinders 15 allow the installation of the lantern rings 422 gripped by the pneumatic fingers 22 on the base body 421 by means of the first guide rails 13. The first servomotors 16 enable, by means of the first rotating shafts 19, the pneumatic fingers 22 to rotate by 90 degrees, while the second servomotors 20 also enable the pneumatic fingers 22 to rotate by 90 degrees. The pneumatic fingers 22 grip the shanks 235 of the retaining pins 23 to bring the pin bodies 231 into fit with the first retaining sleeves 24 and the second retaining sleeves 29, and the retaining lugs 234 with the guide grooves 292. The springs 232 are compressed to cause 90-degree rotation of the pin bodies 231 such that the retaining lugs 234 come into the retaining grooves 291 of the second retaining sleeves 29. The brush 42 is driven by the driving motor 5 to rotate and elevated by the right elevating cylinders 46 to contact with the back cavity of the wheel for deburring.

The invention claimed is:

1. A size-variable wheel deburring device, consisting of a main frame (1), auxiliary frames (2), left elevating frames (3), first guide pillars (4), a driving motor (5), second guide pillars (6), second guide sleeves (7), first guide sleeves (8), a first belt wheel (9), a first lower lifting plate (10), a synchronous belt (11), a second lower lifting plate (12), first guide rails (13), movable plates (14), translational cylinders (15), first servomotors (16), vertical plates (17), first bearing seats (18), first rotating shafts (19), second servomotors (20), U-shaped brackets (21), pneumatic fingers (22), retaining pins (23), first retaining sleeves (24), servo electric cylinders (25), retaining plates (26), second guide rails (27), clamping jaws (28), second retaining sleeves (29), a left holding arm (30), a first gear (31), a first rack (32), a left sliding plate (33), a third guide rail (34), an upper lifting plate (35), third guide pillars (36), a movable bracket (37), third guide sleeves (38), upper lifting cylinders (39), a right sliding plate (40), a right holding arm (41), a brush (42), a second rotating shaft (43), a second bearing seat (44), a second belt wheel (45), right elevating cylinders (46), a stopper (47), a roller way (48), a clamping cylinder (49), a cross beam (50), a fourth guide rail (51), a second rack (52), a third servomotor (53), and a second gear (54), characterized in that, the device comprises left and right combined manipulators, a transfer manipulator, a burr brushing system, and four fixture systems, wherein each combination manipulator is configured as follows: four second guide sleeves (7) being fixed to a platform of the auxiliary frame (2), and four second guide pillars (6) matching with the four second guide sleeves (7) being fixed to a lower end of the second lower lifting plate (12); the left elevating frame (3) being fixed below the platform of the auxiliary frame (2) and having an output end hinged to the bottom of the second lower lifting plate (12); a slider of the first guide rail (13) being fixed above the second lower lifting plate (12); a sliding rail of the first guide rail (13) being fixed below the movable plate (14); the translational cylinder (15) being fixed above the movable plate (14) and having an output end connected to a side surface of the second lower lifting plate (12); the first servomotor (16) being fixed at a left side of the vertical plate (17); the first bearing seat (18) being fixed at a right side of the vertical plate (17); the first rotating shaft (19) being mounted in the first bearing seat (18) by means of a bearing; the U-shaped bracket (21) being mounted at a right side of the first rotating shaft (19), and a left side of the first rotating shaft (19) being connected to an output end of the first servomotor (16); the second servo motor (20) being fixed below the U-shaped bracket (21) and having an output end connected to the pneumatic finger (22) mounted inside the U-shaped bracket (21);

the transfer manipulator being configured as follows: the left holding arm (30) being fixed below the left sliding plate (33) that is mounted below the upper lifting plate (35) by means of the third guide rail (34); the holding arm (41) being fixed below the right sliding plate (40); the first gear (31) being mounted below the upper lifting plate (35); the first rack (32) that is separately fixed to the left sliding plate (33) and the right sliding plate (40) being engaged with the first gear (31); the clamping cylinder (49) being fixed to the left sliding plate (33) and having an output end engaged with the right sliding plate (40); four third guide pillars (36) fixed above the upper lifting plate (35) being matched with four third guide sleeves (38) on a bottom plate of the movable bracket (37); two upper lifting cylinders (39) being fixed to the bottom plate of the movable bracket (37) and having output ends hinged to a top end of the upper lifting plate (35); a side surface of the movable bracket (37) being mounted on the cross beam (50) by means of the fourth guide rail (51); the third servomotor (53) with the second gear (54) mounted at an output end thereof being fixed above a top plate of the movable bracket (37); the second gear (54) being engaged with the second rack (52) that is mounted at a top end of the cross beam (50);

the burr brushing system being configured as follows: four first guide pillars (4) being fixed between a bottom plate and a working platform of the main frame (1), and four first guide sleeves (8) matching with the four first guide pillars (4) being fixed to the first lower lifting plate (10); the driving motor (5) with the first belt wheel (9) mounted at an output end thereof being fixed below the first lower lifting plate (10); the second bearing seat (44) being fixed above the first lower lifting plate (10), and the second rotating shaft (43) being mounted within the second bearing seat (44) by means of a bearing; the brush (42) being fixed to an upper end of the second rotating shaft (43), while the second belt wheel (45) being mounted at a lower end of the second rotating shaft (43); the first belt wheel (9) being connected to the second belt wheel (45) by means of the synchronous belt (11); two right elevating cylinders (46) being fixed to the bottom of the main frame (1) and having output ends hinged to the bottom of the first lower lifting plate (10);

each fixture system being configured as follows: a slider of the second guide rail (27) being fixed to the working platform of the main frame (1); the retaining plate (26) being mounted above a sliding rail; the servo electric cylinder (25) being fixed above the retaining plate (26) and having an output end connected to the vertical plate on the working platform of the main frame (1); the clamping jaw (28) being fixed to a tail end of the second guide rail (27);

the stopper (47) being mounted at a tail end of the roller way (48);

the first retaining sleeves (24) and the second retaining sleeves (29) being fixed below lantern rings (422) and a base body (421), respectively;

the retaining pins (23) being matched with both the first retaining sleeves (24) and the second retaining sleeves (29).

2. The size-variable wheel deburring device according to claim 1, characterized in that, each retaining pin (23) comprises a pin body (231), a spring (232), a catch (233), a retaining lug (234), and a shank (235), with the shank (235) fixed at a left side of the pin body (231), the spring (232) being sleeved the pin body (231), the catch (233) being capable of sliding on the pin body (231) and disposed at a right side of the spring (232), and the retaining lug (234) fixed to a right tail end of the pin body (231).

3. The size-variable wheel deburring device according to claim 1, characterized in that, each of the first retaining sleeves (24) and the second retaining sleeves (29) is provided with a guide groove (292), and each second retaining sleeve (29) is provided at both sides thereof in a 90-degree direction of the guide groove (292) with two retaining grooves (291) for matching with the retaining lug (234) on the corresponding retaining pin (23).

4. The size-variable wheel deburring device according to claim 1, characterized in that, the brush (42) is composed of the base body (421) and the lantern rings (422), wherein a groove is circumferentially formed in the periphery of the base body (421), and the lantern rings (422) are two semicircles with respective semicircular lug bosses at outer sides thereof for matching with the groove in the base body (421).

* * * * *